US009067707B2

(12) United States Patent
Brown

(10) Patent No.: US 9,067,707 B2
(45) Date of Patent: Jun. 30, 2015

(54) EXTENSIBLE PALLET ROTATION APPARATUS

(71) Applicant: Monte Brown, Omaha, NE (US)

(72) Inventor: Monte Brown, Omaha, NE (US)

(73) Assignee: MLB Property, LLC, Omaha, NE (US)

( * ) Notice: Subject to any disclaimer, the term of this patent is extended or adjusted under 35 U.S.C. 154(b) by 0 days.

(21) Appl. No.: 13/801,179

(22) Filed: Mar. 13, 2013

(65) Prior Publication Data

US 2014/0116300 A1 May 1, 2014

Related U.S. Application Data

(60) Provisional application No. 61/721,340, filed on Nov. 1, 2012, provisional application No. 61/722,423, filed on Nov. 5, 2012, provisional application No. 61/756,201, filed on Jan. 24, 2013.

(51) Int. Cl.

| | |
|---|---|
| ***B65D 19/38*** | (2006.01) |
| ***B65D 19/00*** | (2006.01) |
| ***B60P 7/08*** | (2006.01) |

(52) U.S. Cl.

CPC ..... *B65D 19/38* (2013.01); *B65D 19/0002* (2013.01); *B65D 2519/00273* (2013.01); *B65D 19/0026* (2013.01); *B65D 2519/00288* (2013.01); *B65D 2519/00323* (2013.01); *B65D 2519/00333* (2013.01); *B65D 2519/00761* (2013.01); *B65D 2519/00805* (2013.01)

(58) Field of Classification Search

CPC .. B63B 25/22; B63B 2025/245; B63B 25/24; B65D 19/0002; B65D 2519/00273; B65D 2519/00293; B65D 2519/00323; B65D 2519/00567; B65D 2519/00761; B65D 2585/6865; B65D 2585/6867; B65D 2585/6872; B65D 85/68

USPC ..... 410/1, 52, 56, 65–67, 77, 78, 80; 206/565, 557; 108/54.1, 55.1, 55.5

See application file for complete search history.

(56) References Cited

U.S. PATENT DOCUMENTS

| | | | | |
|---|---|---|---|---|
| 2,377,911 | A * | 6/1945 | Warren | 108/54.1 |
| 2,405,535 | A * | 8/1946 | Roy Weiss Le | 108/54.1 |
| 2,942,827 | A * | 6/1960 | Edson | 108/54.1 |
| 4,805,859 | A * | 2/1989 | Hudson | 248/148 |
| 5,706,738 | A | 1/1998 | Rapeli | 108/54.1 |
| 6,485,239 | B2 * | 11/2002 | Afful | 410/80 |
| 6,595,731 | B1 | 7/2003 | Johansson et al. | 410/52 |
| 6,824,338 | B2 * | 11/2004 | Looker | 410/67 |
| 2005/0194287 | A1 | 9/2005 | Lien et al. | 206/565 |
| 2012/0039684 | A1 | 2/2012 | Baker | 410/66 |

FOREIGN PATENT DOCUMENTS

JP 08-207935 A 8/1996

OTHER PUBLICATIONS

International Search Report mailed Oct. 15, 2013, in Application Serial No. PCT/US2013/048897.

* cited by examiner

*Primary Examiner* — Glenn Dayoan
*Assistant Examiner* — Sunsurraye Westbrook
(74) *Attorney, Agent, or Firm* — Ryan T. Grace; Advent, LLP

(57) ABSTRACT

Aspects of the disclosure relate to a pallet assembly configured to provide access to goods stacked thereon. The pallet assembly includes a base frame and an extensible frame coupled with the base frame. The extensible frame is configured to translate between a retracted orientation with respect to the base frame and an extended orientation with respect to the base frame.

22 Claims, 20 Drawing Sheets

EXTENSIBLE PALLET ROTATION APPARATUS

CROSS-REFERENCE TO RELATED APPLICATIONS

The present application claims the benefit under 35 U.S.C. §119(e) of U.S. Provisional Application Ser. No. 61/721,340, filed Nov. 1, 2012, and titled "EXTENSIBLE PALLET ROTATION APPARATUS"; U.S. Provisional Application Ser. No. 61/722,423, filed Nov. 5, 2012, and titled "EXTENSIBLE PALLET ROTATION APPARATUS"; and U.S. Provisional Application Ser. No. 61/756,201, filed Jan. 24, 2013, and titled "EXTENSIBLE PALLET ROTATION APPARATUS". U.S. Provisional Applications Ser. Nos. 61/721,340; 61/722,423; and 61/756,201 are herein incorporated by reference in their entireties.

BACKGROUND

A pallet (also referred to as a skid) is a flat support structure used to support goods so that the goods can be stably lifted and transported with a lifting device, such as a forklift, a pallet jack, a front loader, and so forth.

SUMMARY

Aspects of the disclosure relate to a pallet assembly configured to provide access to goods stacked thereon. The pallet assembly includes a base frame and an extensible frame coupled with the base frame. The extensible frame is configured to translate between a retracted orientation with respect to the base frame and an extended orientation with respect to the base frame. A support surface configured to support goods stacked thereon is disposed of the extensible frame, One or more additional extensible frames can be coupled between the base frame and the extensible frame. The support surface can be provided by a support supported by the extensible frame. The support can be configured to rotate with respect to the extensible frame to provide access to goods stacked thereon.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures can indicate similar or identical items.

FIG. 1A is an isometric view illustrating a pallet assembly including a base frame, a first extensible frame coupled with the base frame, a second extensible frame coupled between the base frame and the first extensible frame, and a support supported by the first extensible frame and having a support surface configured to support goods stacked thereon, where the first extensible frame is configured to translate between a retracted orientation with respect to the base frame and an extended orientation with respect to the base frame, and where the support is configured to rotate with respect to the first extensible frame to provide access to goods stacked thereon, the first extensible frame positioned in the retracted orientation in accordance with an example implementation of the present disclosure.

Figure 2:
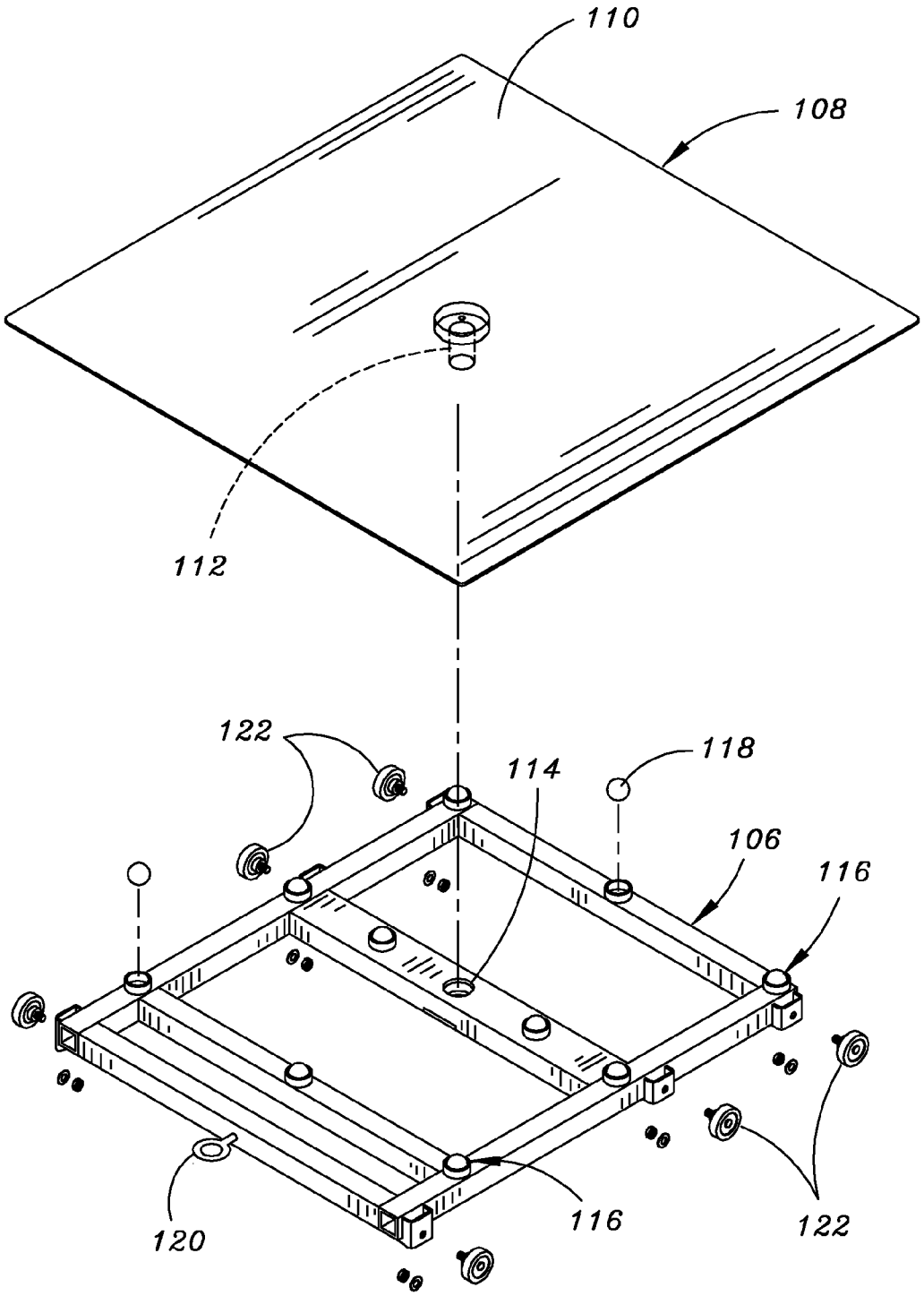
FIG. 2 is an exploded isometric view illustrating a first extensible frame and a support supported by the first extensible frame and having a support surface, where the support is configured to rotate with respect to the first extensible frame in accordance with an example implementation of the present disclosure.
Figure 3:
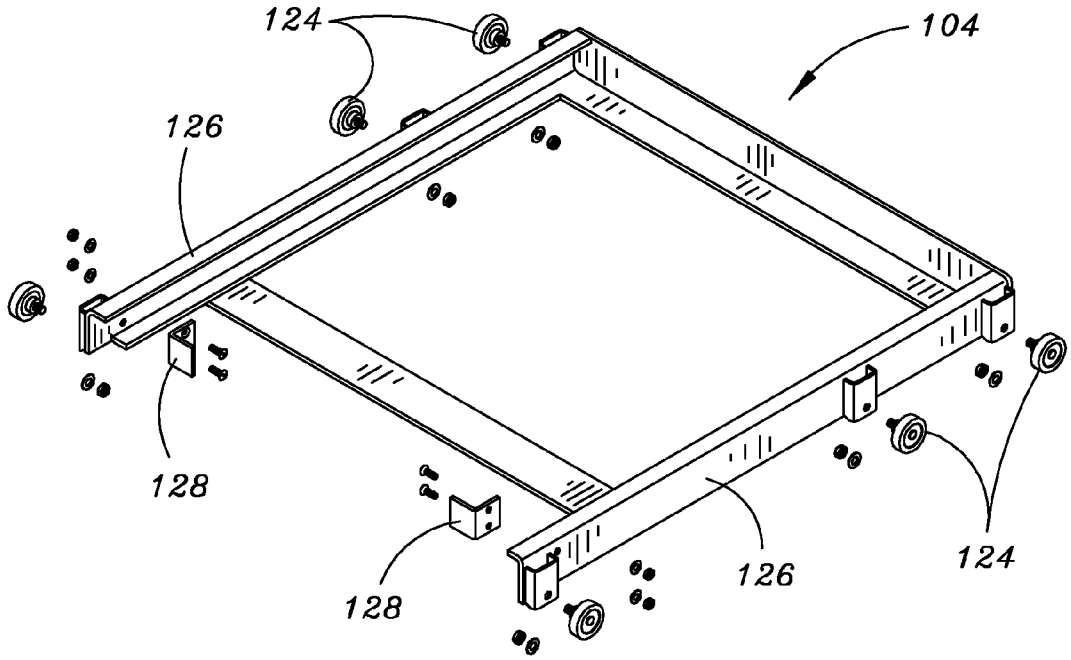

FIG. 3 is an exploded isometric view illustrating a second extensible frame for coupling between a base frame and a first extensible frame, such as the first extensible frame shown in FIG. 2, where the second extensible frame is configured to facilitate translation of the first extensible frame between a retracted orientation with respect to the base frame and an extended orientation with respect to the base frame in accordance with an example implementation of the present disclosure.

Figure 4:
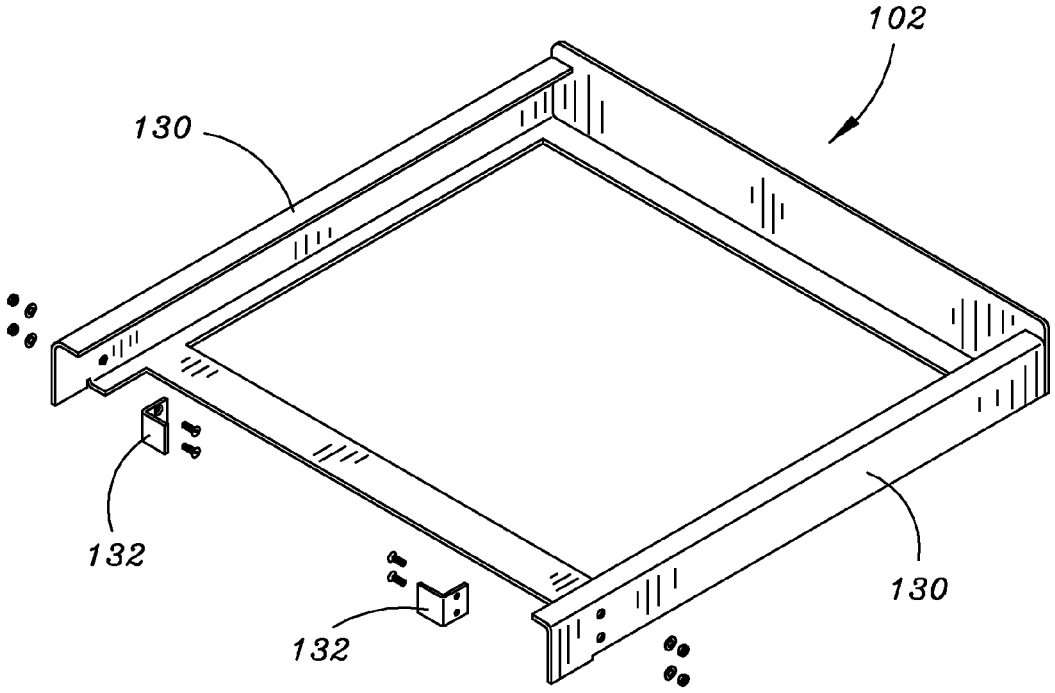

FIG. 4 is an exploded isometric view illustrating a base frame for coupling with an extensible frame, such as the second extensible frame shown in FIG. 3, in accordance with an example implementation of the present disclosure.

Figure 5A:
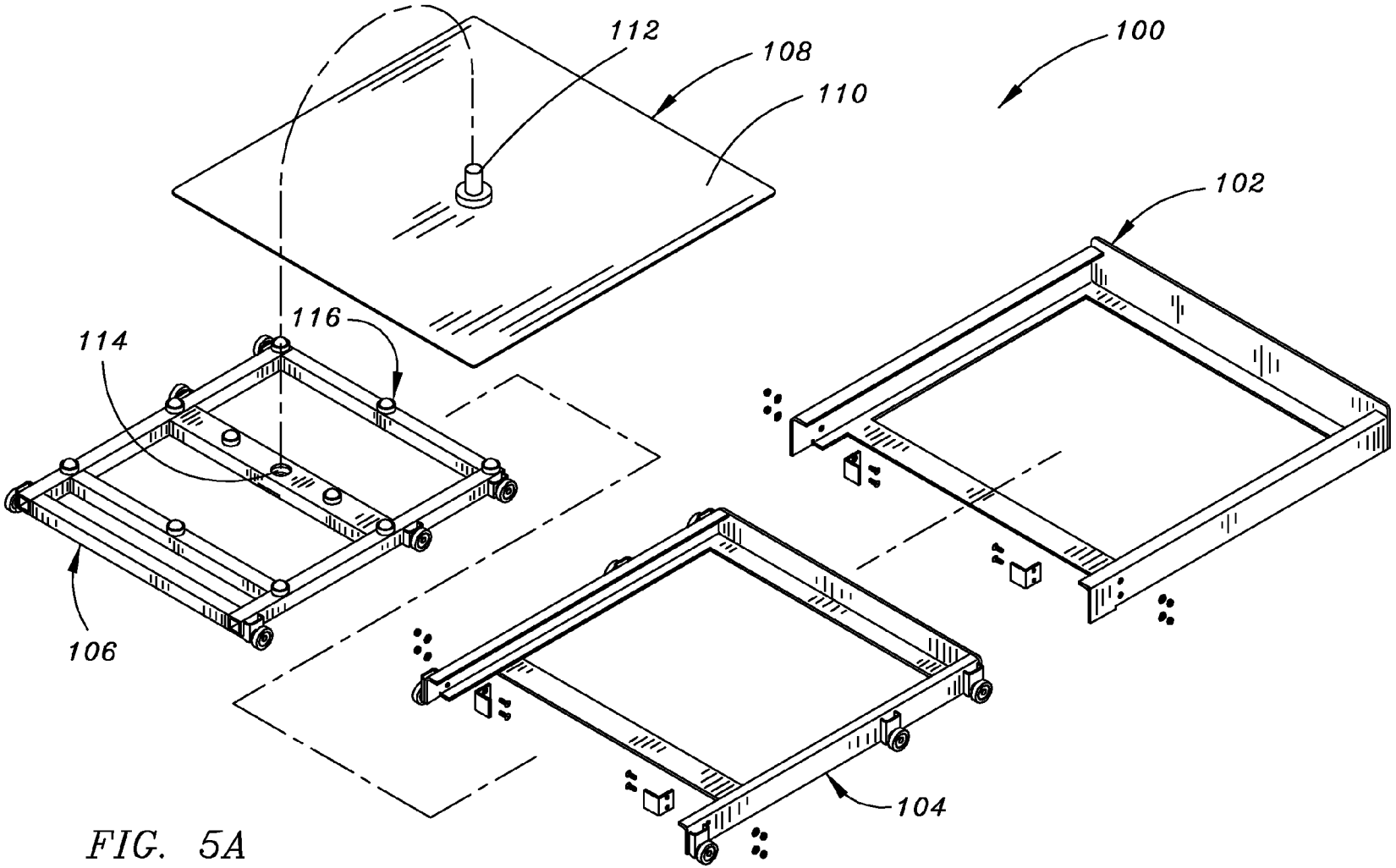

FIG. 5A is an exploded isometric view illustrating a pallet assembly including a base frame, a first extensible frame coupled with the base frame, a second extensible frame coupled between the base frame and the first extensible frame, and a support supported by the first extensible frame and having a support surface configured to support goods stacked thereon, where the first extensible frame is configured to translate between a retracted orientation with respect to the base frame and an extended orientation with respect to the base frame, and where the support is configured to rotate with respect to the first extensible frame to provide access to goods stacked thereon in accordance with an example implementation of the present disclosure.

Figure 5B:
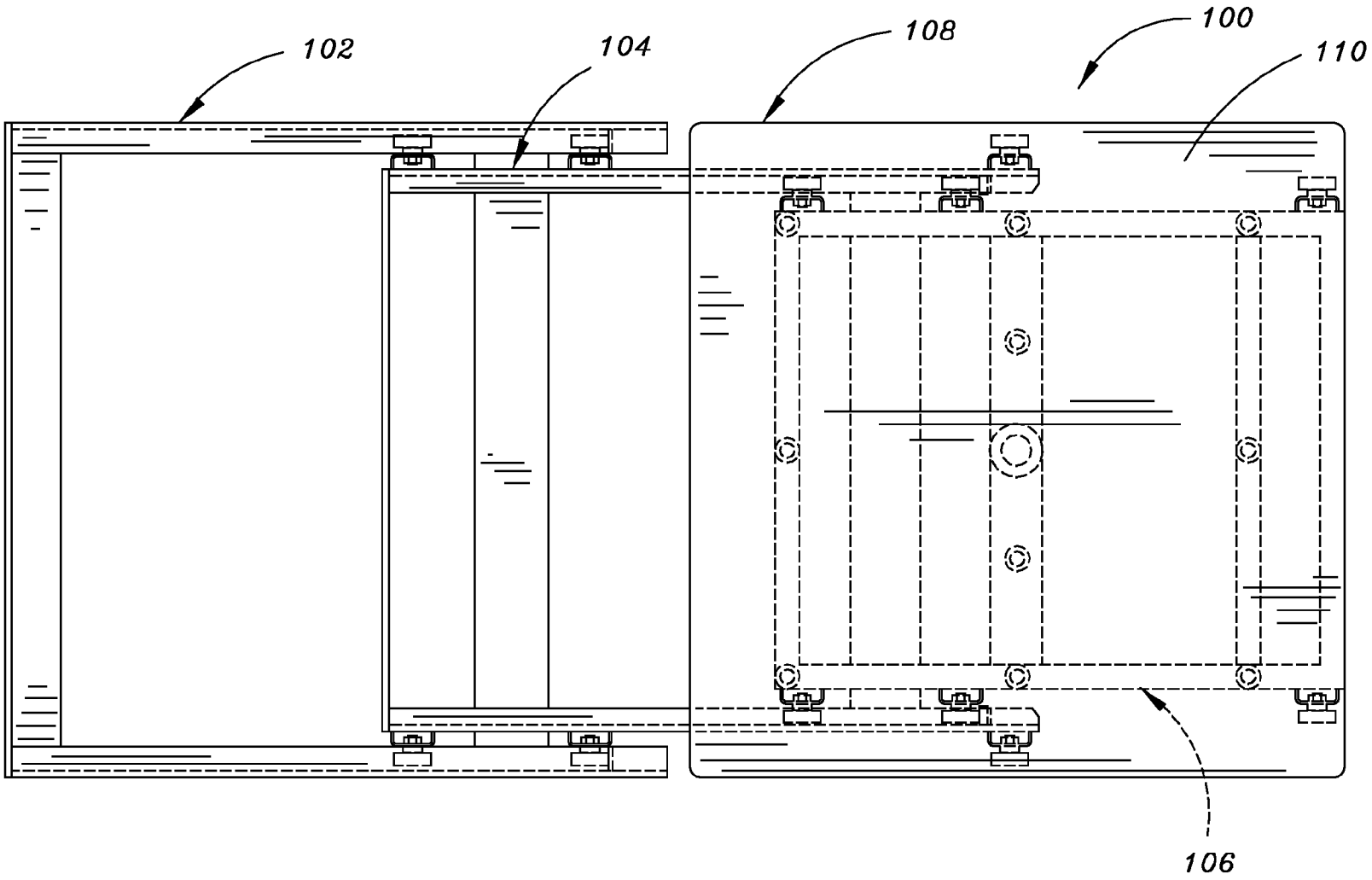

FIG. 5B is a top plan view of the pallet assembly illustrated in FIG. 5A, where the first extensible frame is positioned in the extended orientation in accordance with an example implementation of the present disclosure.

Figure 5C:
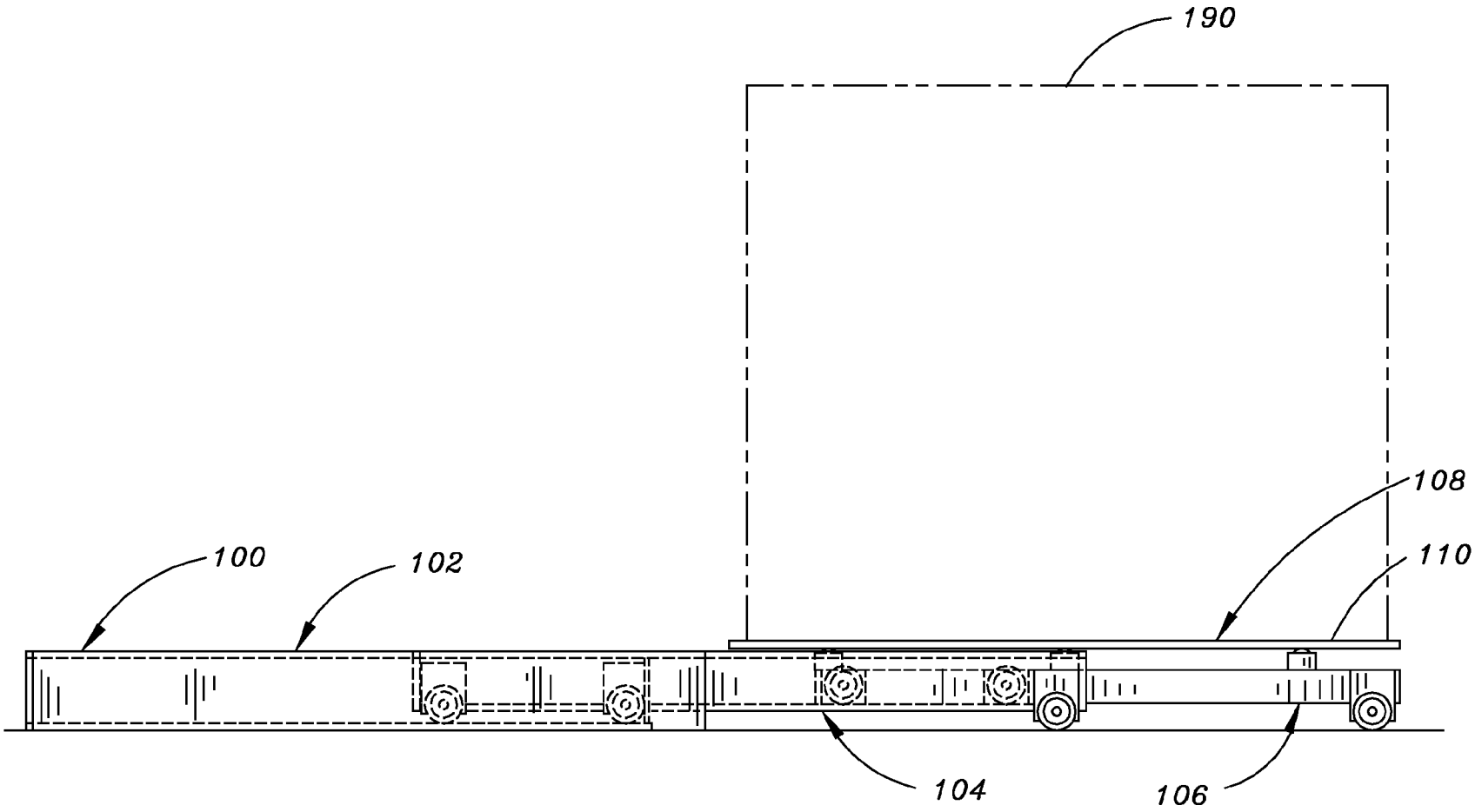

FIG. 5C is a side elevation view of the pallet assembly illustrated in FIG. 5A, where the first extensible frame is positioned in the extended orientation in accordance with an example implementation of the present disclosure.

Figure 6A:
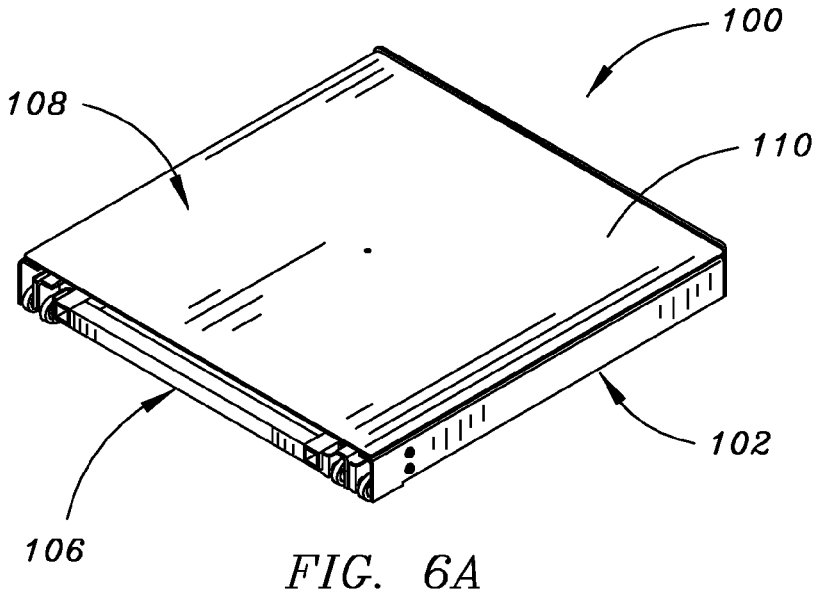

FIG. 6A is an isometric view illustrating a pallet assembly including a base frame, a first extensible frame coupled with the base frame, a second extensible frame coupled between the base frame and the first extensible frame, and a support supported by the first extensible frame and having a support surface, where the first extensible frame is configured to translate between a retracted orientation with respect to the base frame and an extended orientation with respect to the base frame, and where the support is configured to rotate with respect to the first extensible frame in accordance with an example implementation of the present disclosure.

Figure 6B:
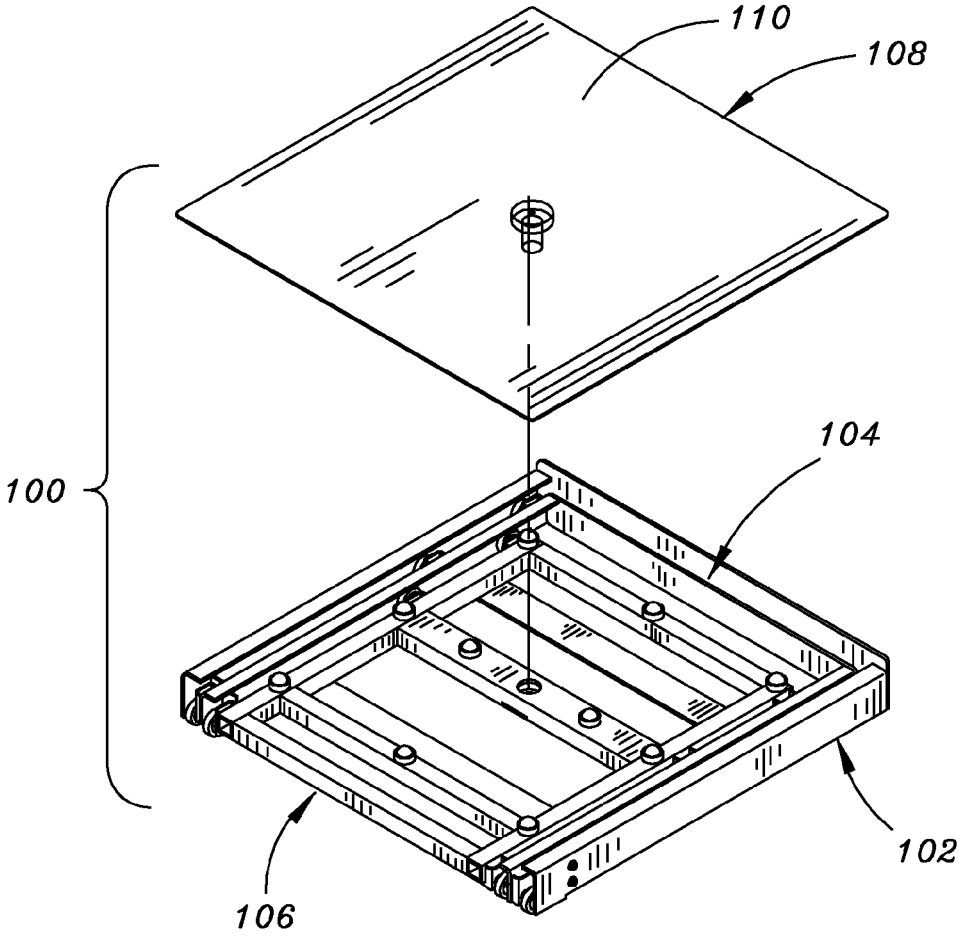

FIG. 6B is an exploded isometric view of the pallet assembly illustrated in FIG. 6A.

Figure 6C:
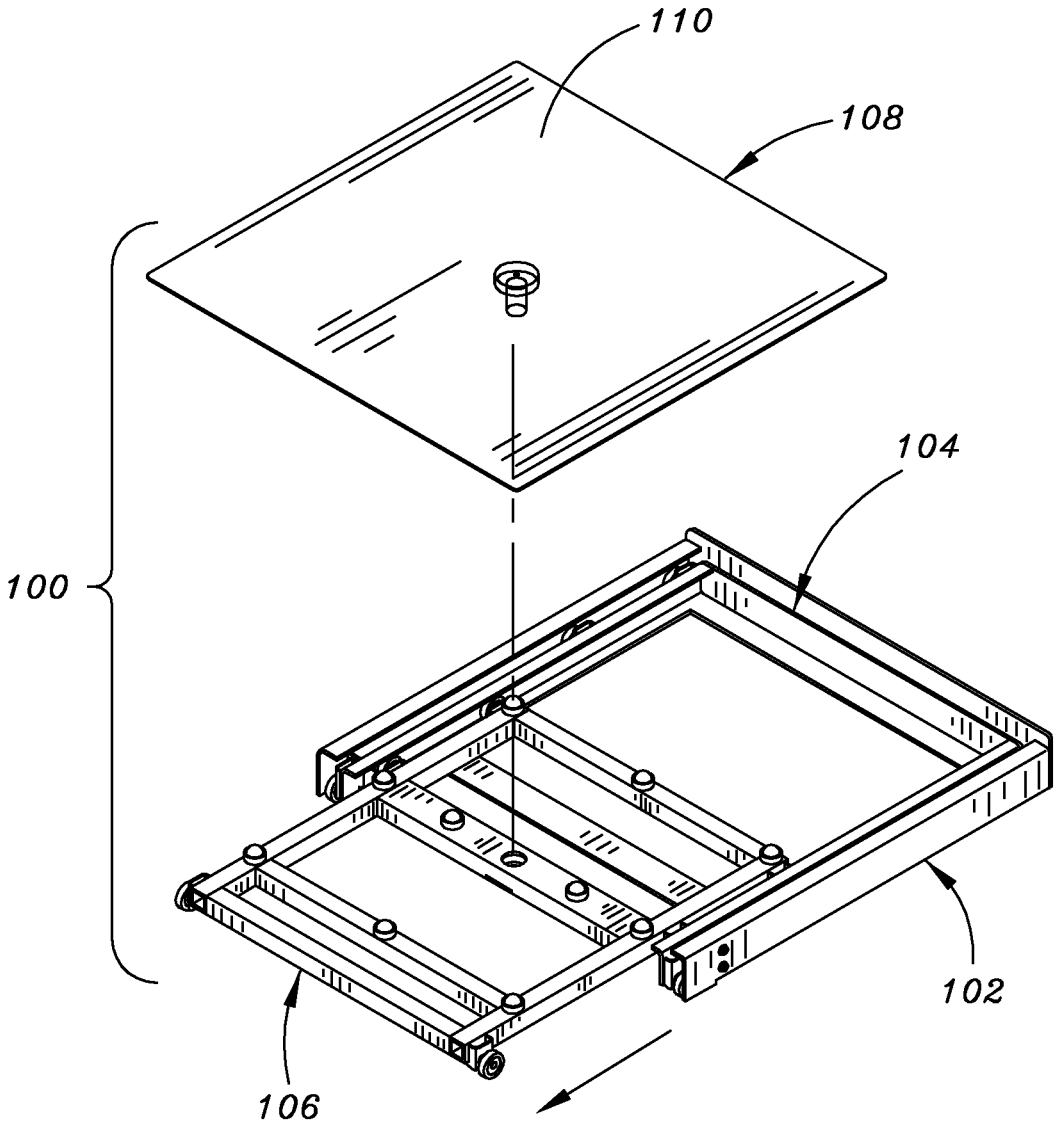

FIG. 6C is an exploded isometric view of the pallet assembly illustrated in FIG. 6A, where the first extensible frame is partially extended in accordance with an example implementation of the present disclosure.

Figure 6D:
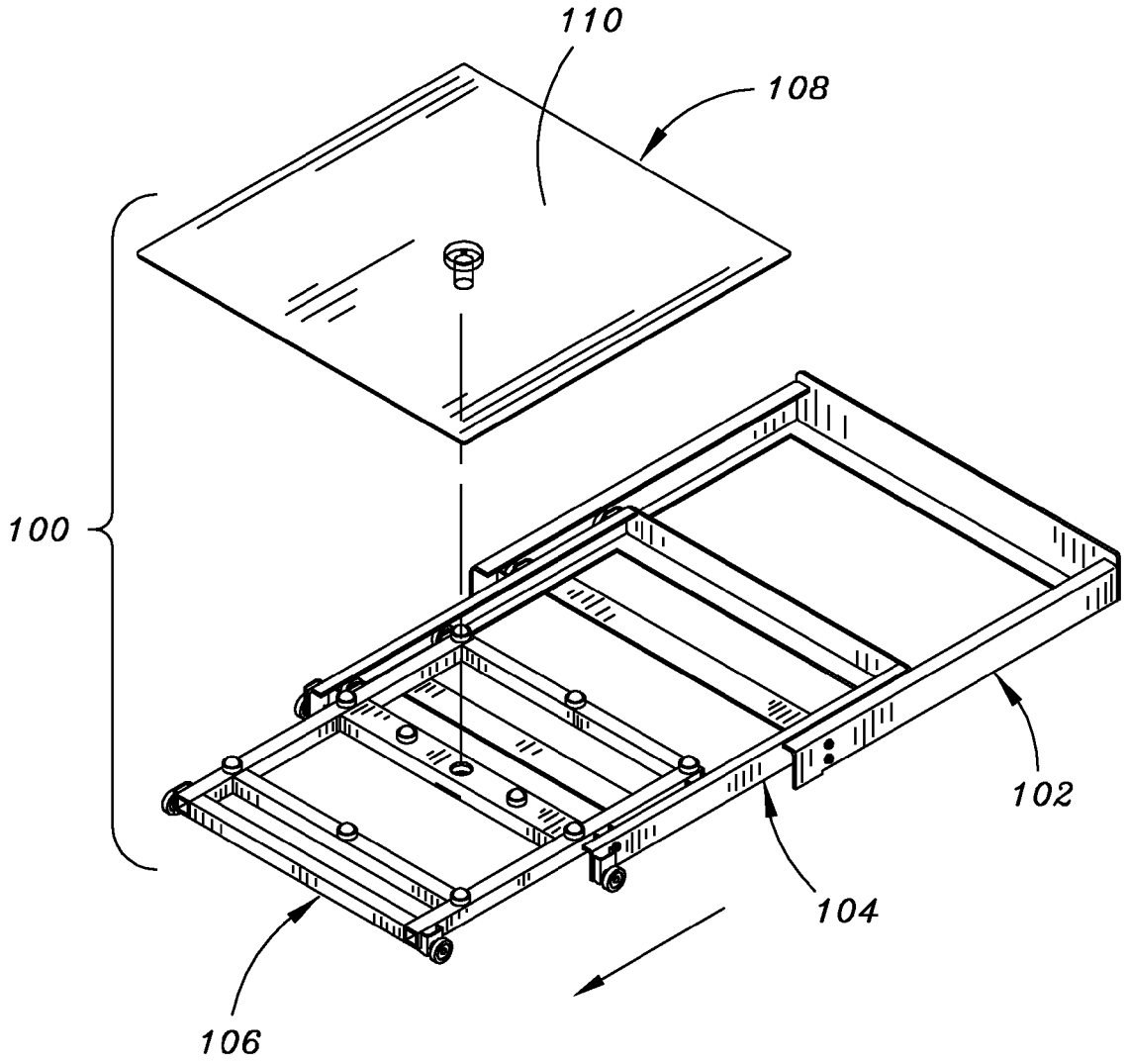

FIG. 6D is an exploded isometric view of the pallet assembly illustrated in FIG. 6A, where the first extensible frame is fully extended in accordance with an example implementation of the present disclosure.

Figure 6E:
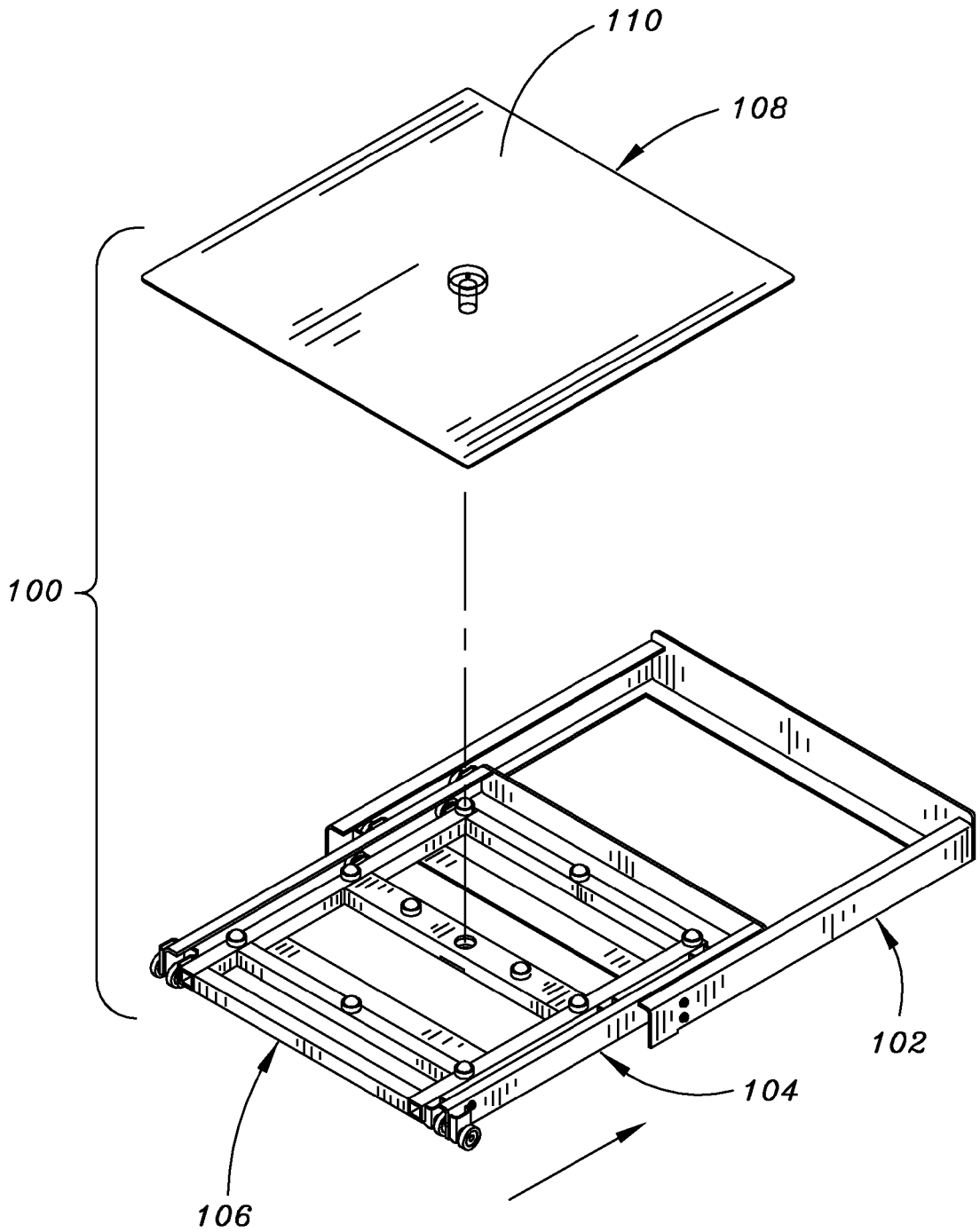

FIG. 6E is an exploded isometric view of the pallet assembly illustrated in FIG. 6A, where the first extensible frame is partially retracted in accordance with an example implementation of the present disclosure.

Figure 7A:
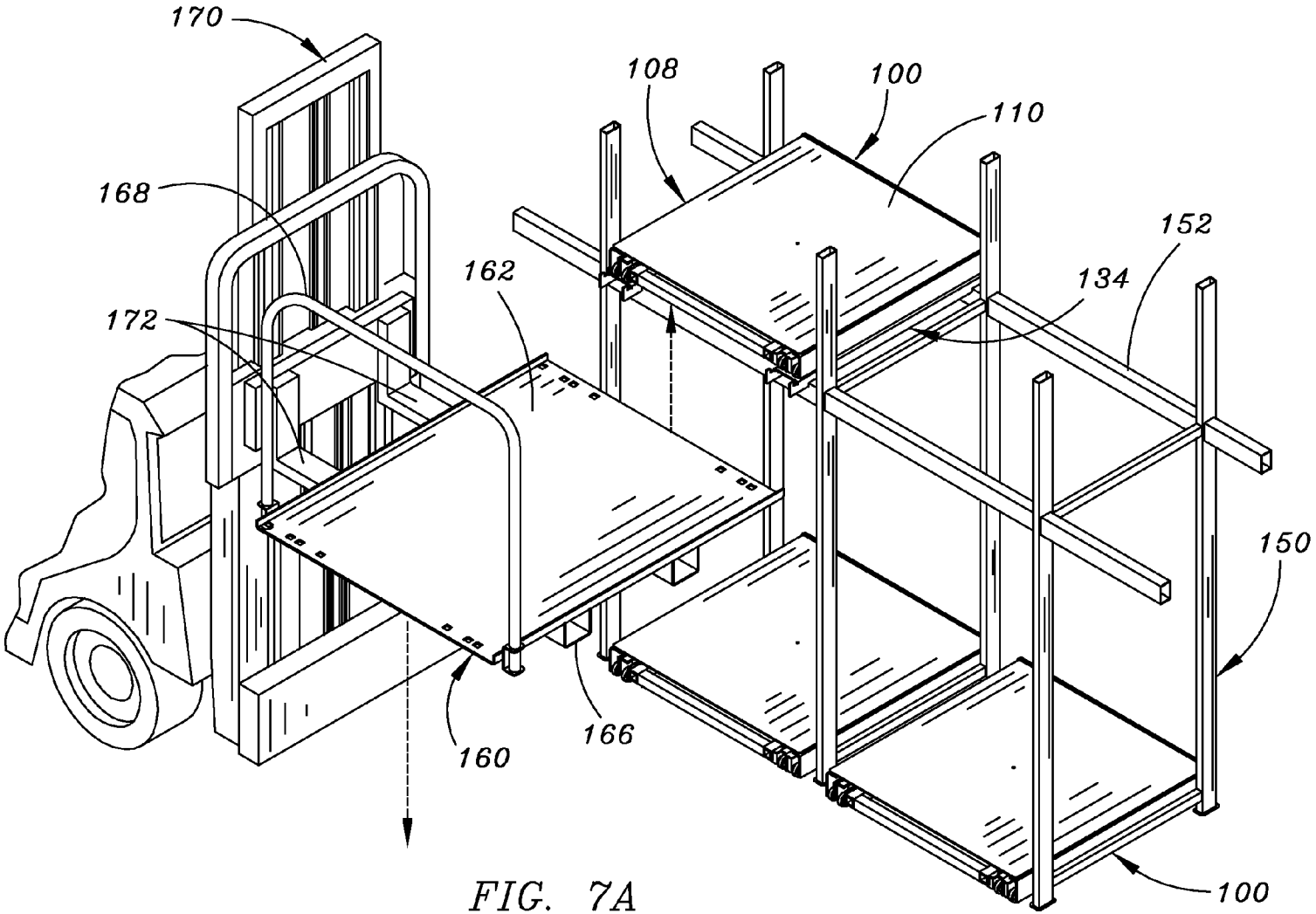

FIG. 7A is an isometric view illustrating a pallet assembly including a base frame, an extensible frame coupled with the base frame, a support supported by the extensible frame and having a support surface configured to support goods stacked thereon, and support members supporting the base frame, where the extensible frame is configured to translate between a retracted orientation with respect to the base frame and an extended orientation with respect to the base frame, the support is configured to rotate with respect to the first extensible frame to provide access to goods stacked thereon, the support members include hooks for interfacing with a platform lifted by a forklift truck, and where the first extensible frame is positioned in the retracted orientation in accordance with an example implementation of the present disclosure.

Figure 7B:
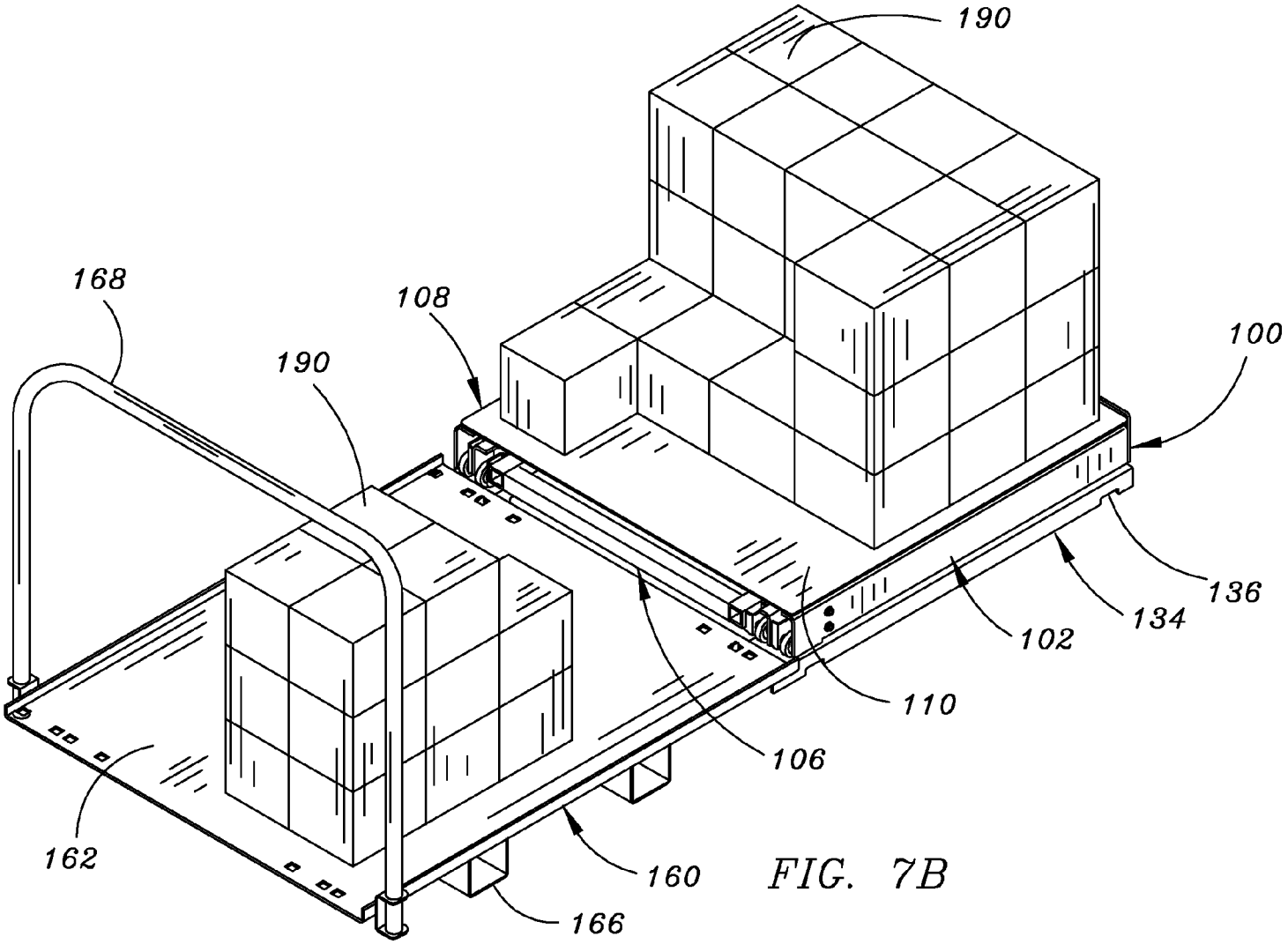

FIG. 7B is an isometric view of the pallet assembly illustrated in FIG. 7A, where the platform interfaces with the support members to align the support surface of the support with a support surface of the platform, and where a portion of the goods stacked on the pallet assembly is removed from the pallet assembly and stacked on the platform.

Figure 7C:
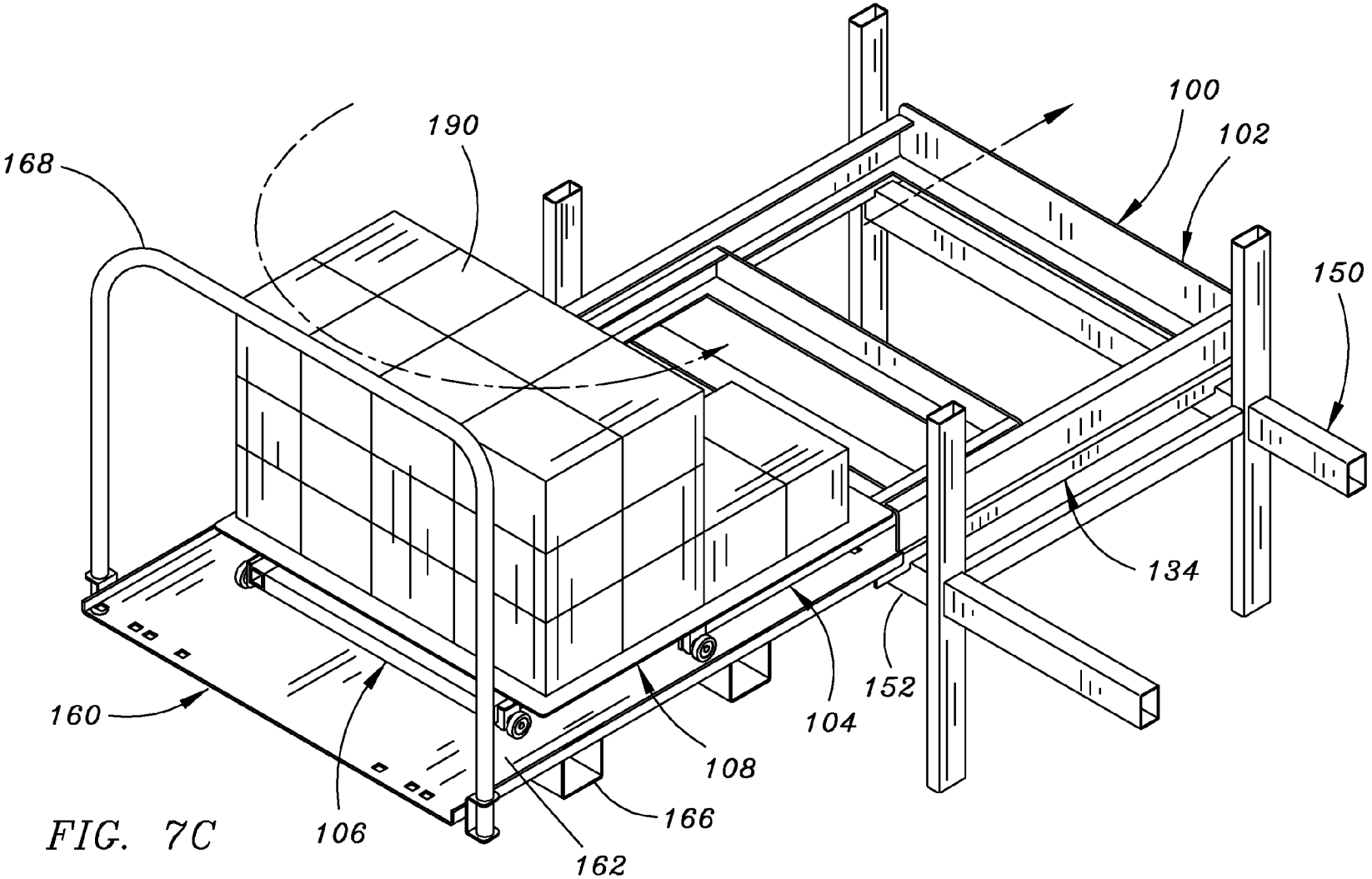

FIG. 7C is another isometric view of the pallet assembly illustrated in FIG. 7A, where the first extensible frame is positioned in the extended orientation, and the support is rotated to provide access to the goods stacked on the pallet assembly.

Figure 8:
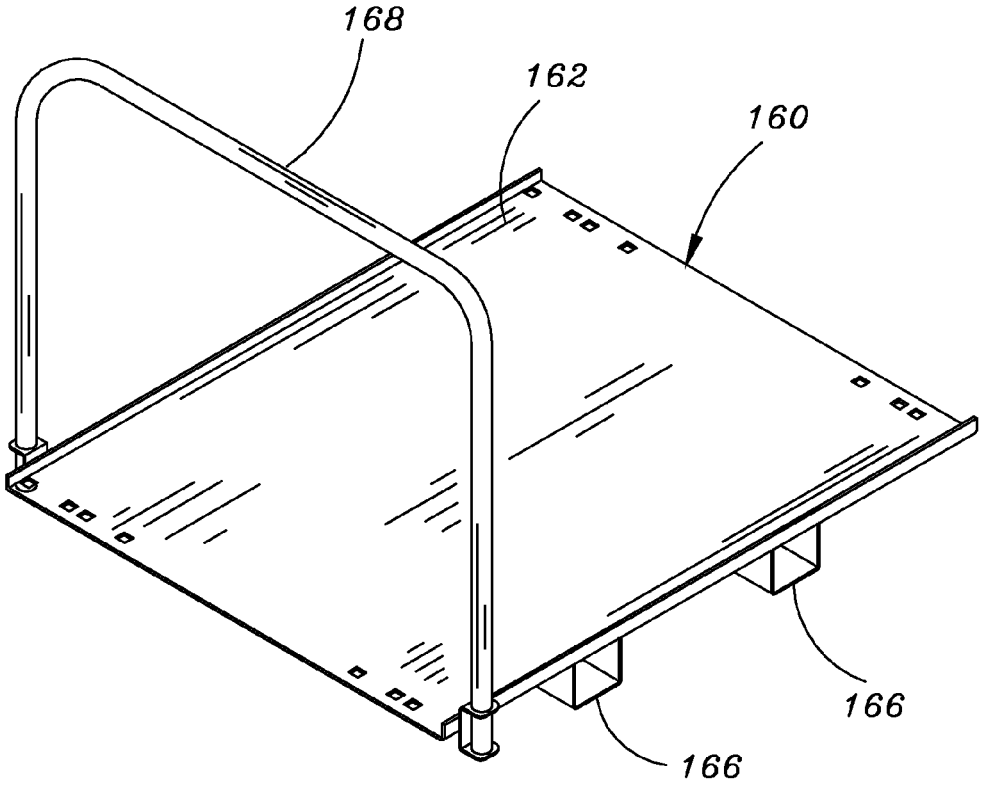

FIG. 8 is an isometric view illustrating a platform for interfacing with a pallet assembly, such as the pallet assembly illustrated in FIG. 7A, in accordance with an example implementation of the present disclosure.

Figure 9:
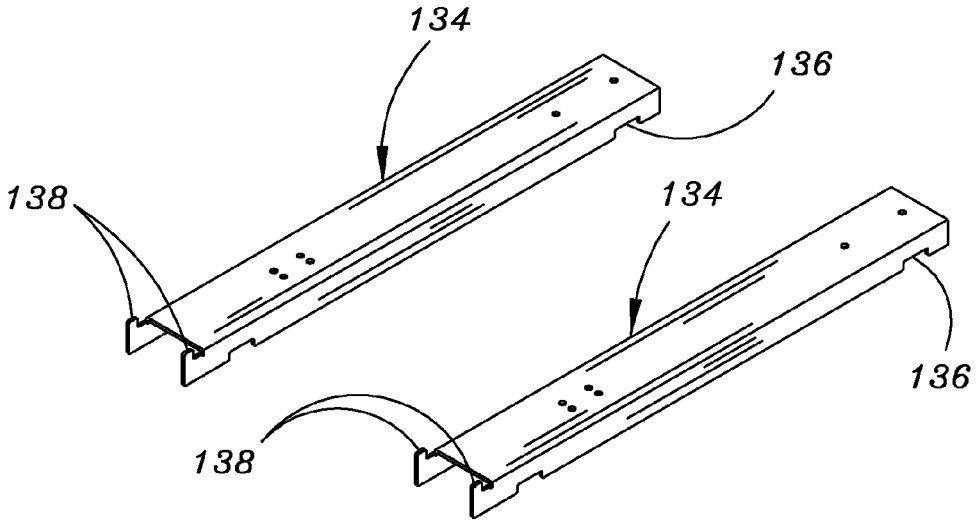

FIG. 9 is an isometric view illustrating support members for supporting a base frame, such as the base frame of the pallet assembly illustrated in FIG. 7A.

Figure 10:
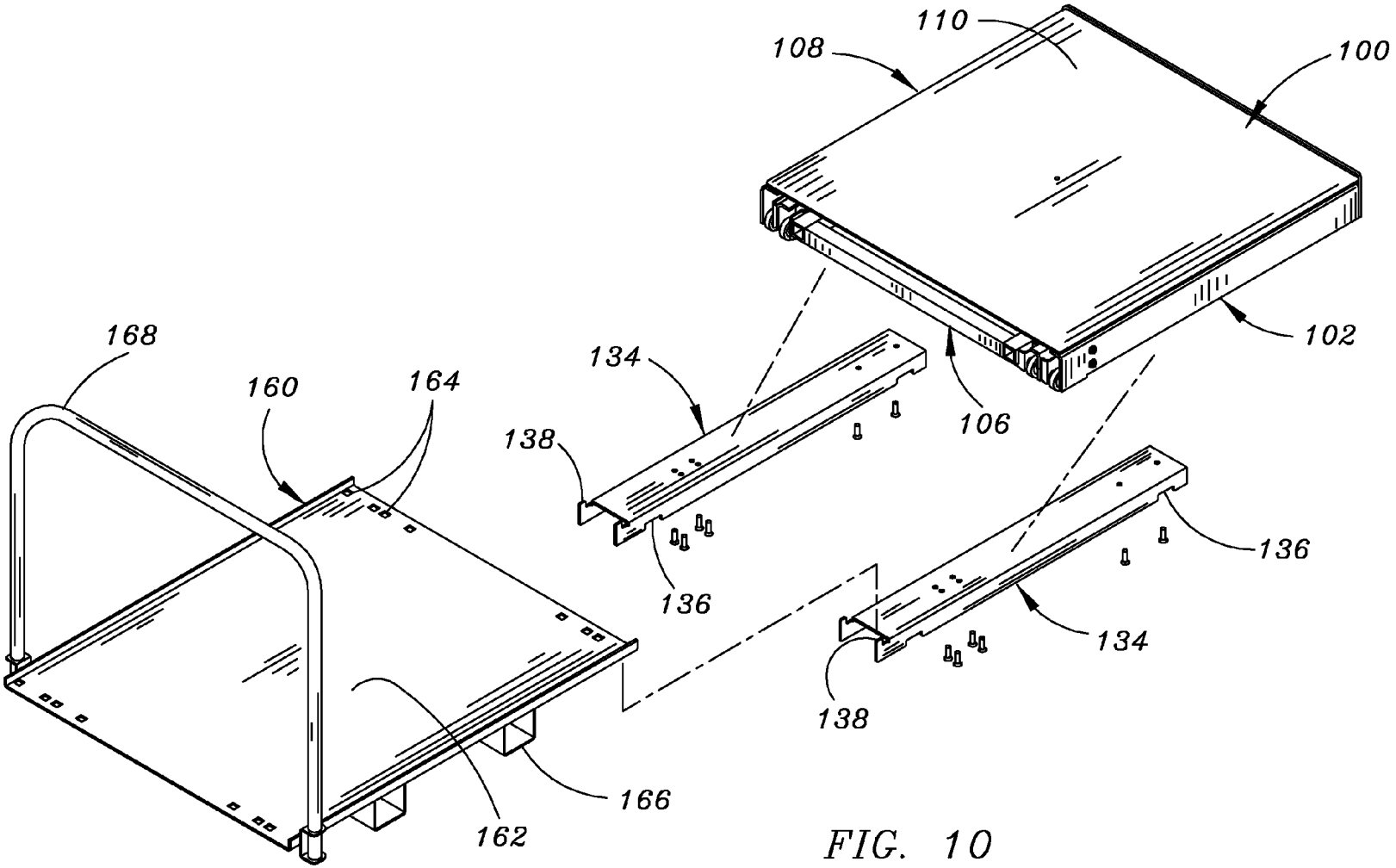

FIG. 10 is an exploded isometric view illustrating a pallet assembly and a platform configured to interface with the pallet assembly in accordance with an example implementation of the present disclosure.

Figure 11A:
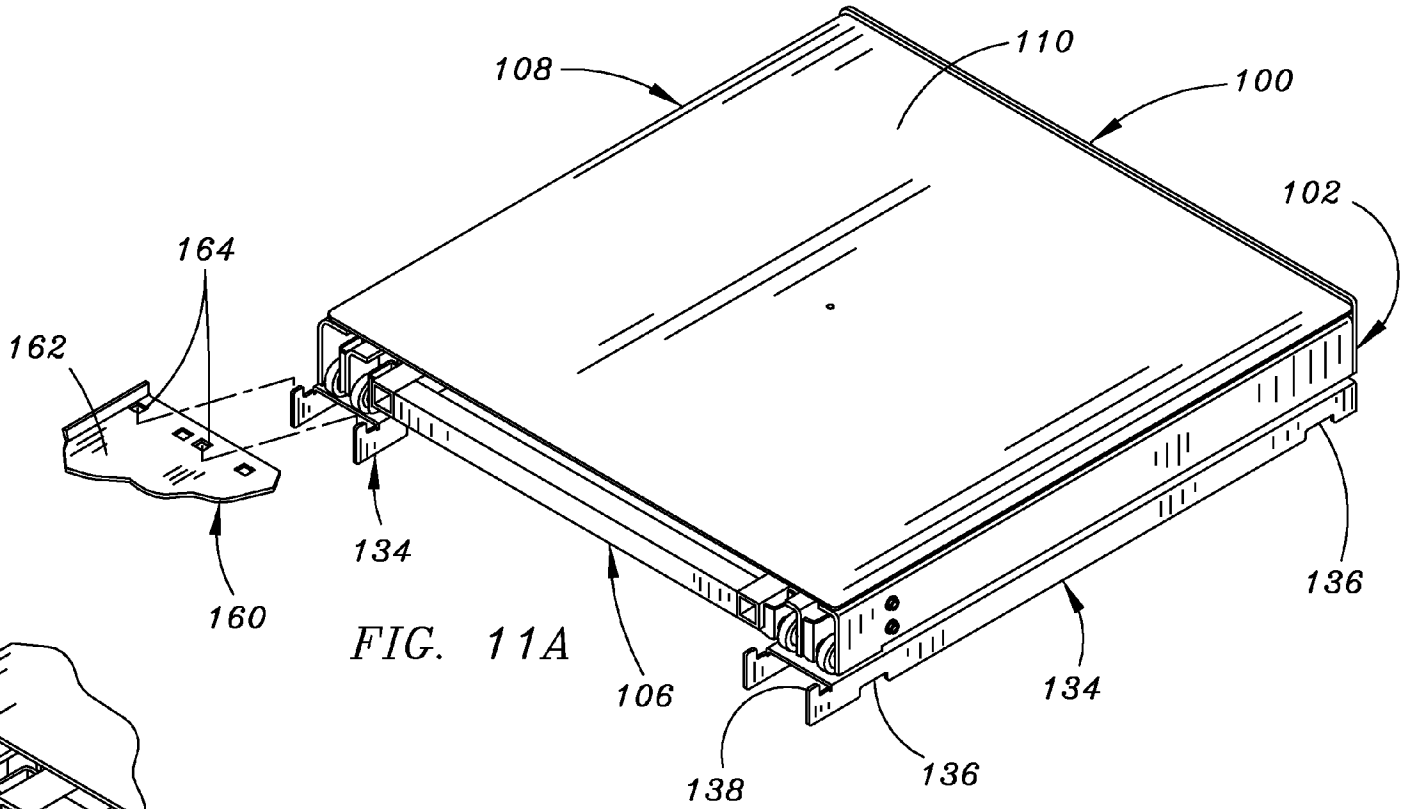

FIG. 11A is a partial isometric view illustrating a pallet assembly and a platform configured to interface with the pallet assembly in accordance with an example implementation of the present disclosure.

Figure 11B:
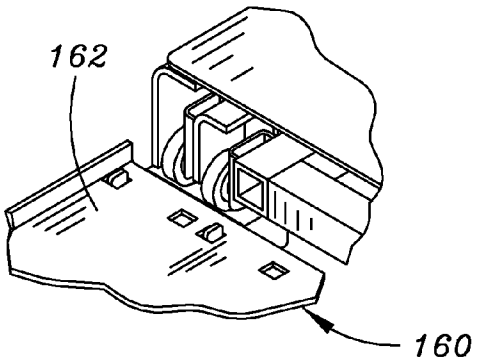

FIG. 11B is a partial isometric view of the pallet assembly and the platform illustrated in FIG. 11A, where the platform is shown interfacing with the pallet assembly.

Figure 11C:
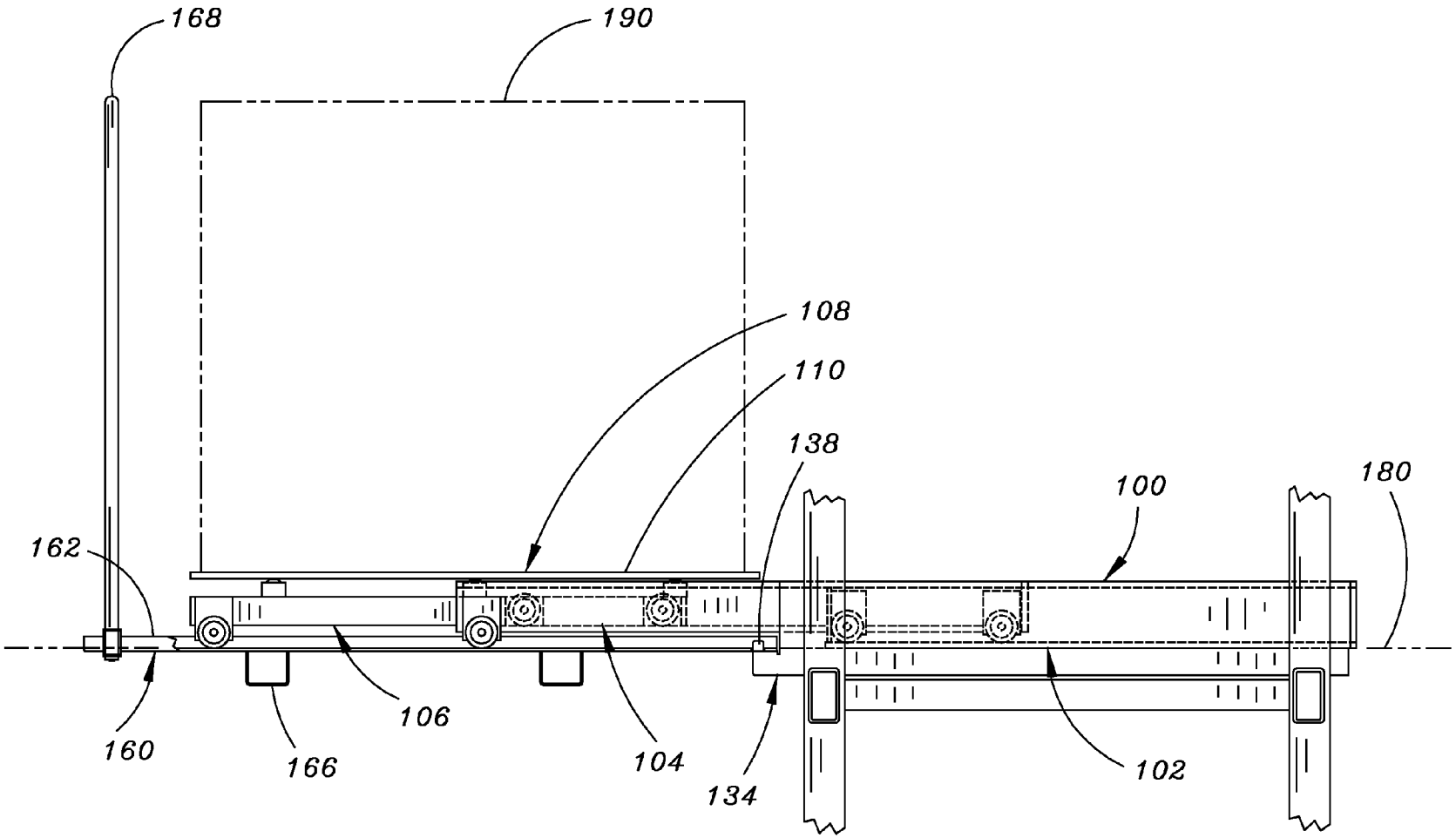

FIG. 11C is a side elevation view of the pallet assembly and the platform illustrated in FIG. 11A, where the platform is shown interfacing with the pallet assembly.

DETAILED DESCRIPTION

Goods stacked on pallets are typically transported and stored within a storage environment such as a stockroom or warehouse. The goods are often stored on the pallets used to transport them in such environments. However, as inventory stacked on a pallet is depleted from the front of the pallet (e.g., removed from a side of the pallet generally facing the center of a storage facility such as a warehouse), it may become difficult to access goods stacked near the back of the pallet (e.g., goods stacked near a side of the pallet generally opposite the center of a storage facility). This difficulty can be compounded when additional goods are stacked near the front of a pallet, possibly in front of goods previously stacked near the back of the pallet. A lack of easy access to goods near the back of a pallet can lead to expired and/or outdated goods. This lack of easy access can also make it difficult to inventory the goods in a storage environment.

Accordingly, pallet assemblies are described that are configured to provide access to goods stacked thereon. The pallet assemblies include a base frame and an extensible frame coupled with the base frame. The extensible frame is configured to translate between a retracted orientation with respect to the base frame and an extended orientation with respect to the base frame. A support surface configured to support goods stacked thereon is disposed of the extensible frame. One or more additional extensible frames can be coupled between the base frame and the extensible frame. The support surface can be provided by a support supported by the extensible frame. The support can be configured to rotate with respect to the extensible frame to provide access to goods stacked thereon.

Example Embodiments

Referring to FIGS. 1 through 6, pallet assemblies 100 configured to provide access to stacked goods are described. The pallet assemblies 100 include a base frame 102 and an extensible frame 106. The pallet assemblies 100 are configured to receive stacked goods 190. In embodiments of the disclosure, the goods 190 are stacked in packages/containers, such as cardboard boxes, plastic containers, wooden containers, shipping boxes, shipping crates, pallet-sized containers (e.g., bulk boxes, skid boxes, gaylords), and so forth. For example, the goods 190 can include packaged beverages (e.g., cases of soda pop). The goods 190 can be stacked from one end of a pallet assembly 100 to another end of the pallet assembly 100. For instance, goods can be stacked from a side of the pallet assembly 100 generally facing the center of a storage facility such as a warehouse to a side of the pallet assembly 100 generally opposite the center of the storage facility.

Figure 1A:
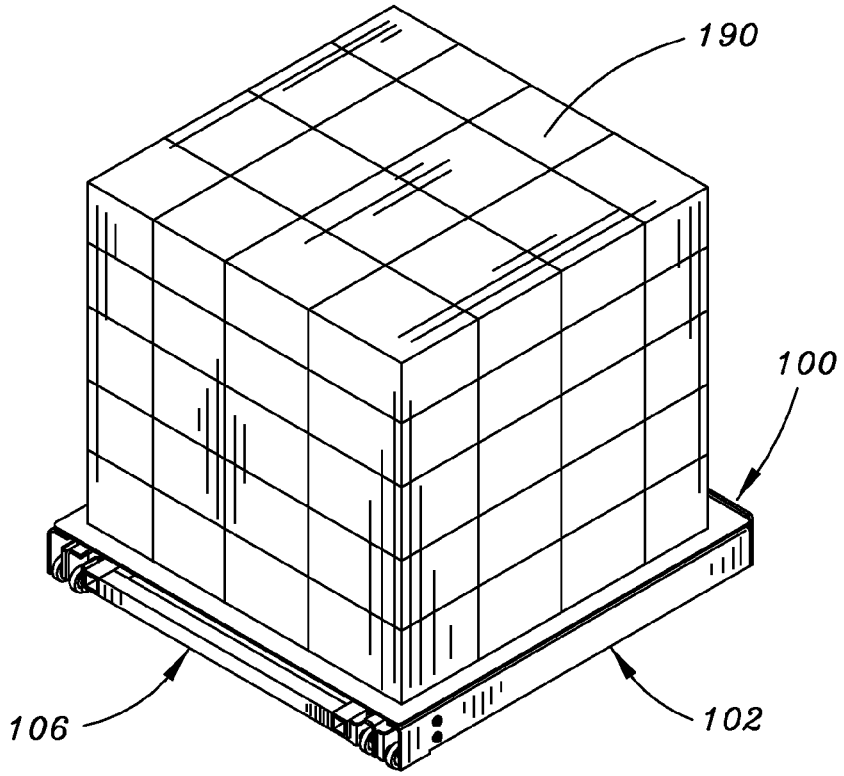
FIG. 1B is an isometric view of the pallet assembly illustrated in FIG. 1A, where a portion of the goods stacked on the pallet assembly has been removed from the pallet assembly.
FIG. 1C is another isometric view of the pallet assembly illustrated in FIG. 1A, where the first extensible frame is positioned in the extended orientation.
FIG. 1D is a further isometric view of the pallet assembly illustrated in FIG. 1A, where the support is rotated to provide access to the goods stacked on the pallet assembly.
FIG. 1E is another isometric view of the pallet assembly illustrated in FIG. 1A, where the first extensible frame is positioned in the retracted orientation.
Figure 1B:
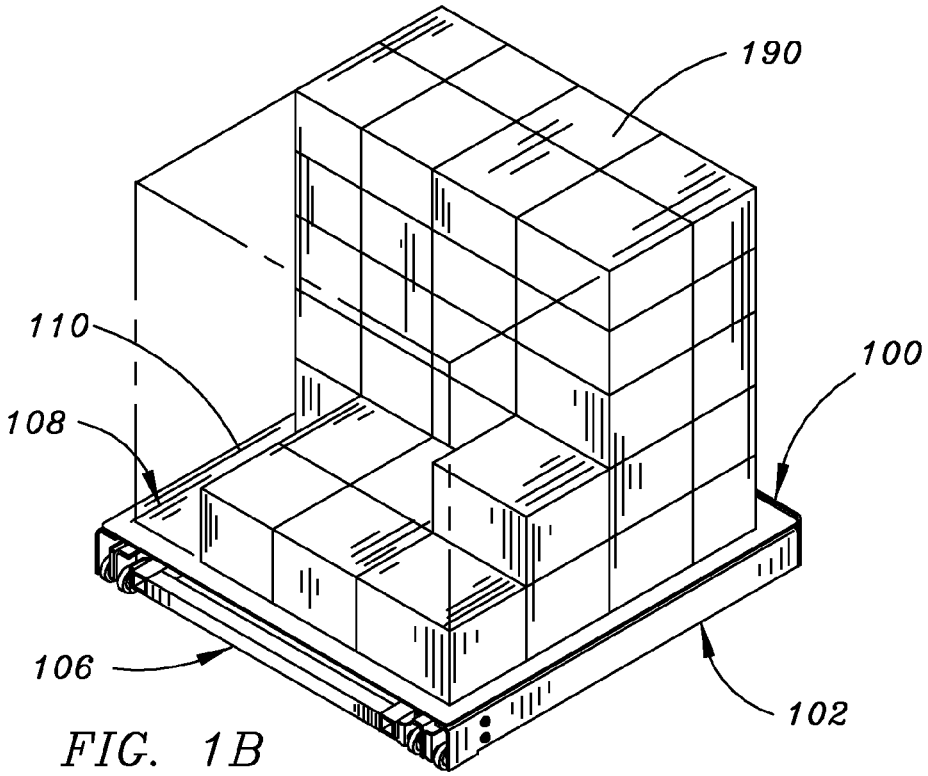
Figure 1C:
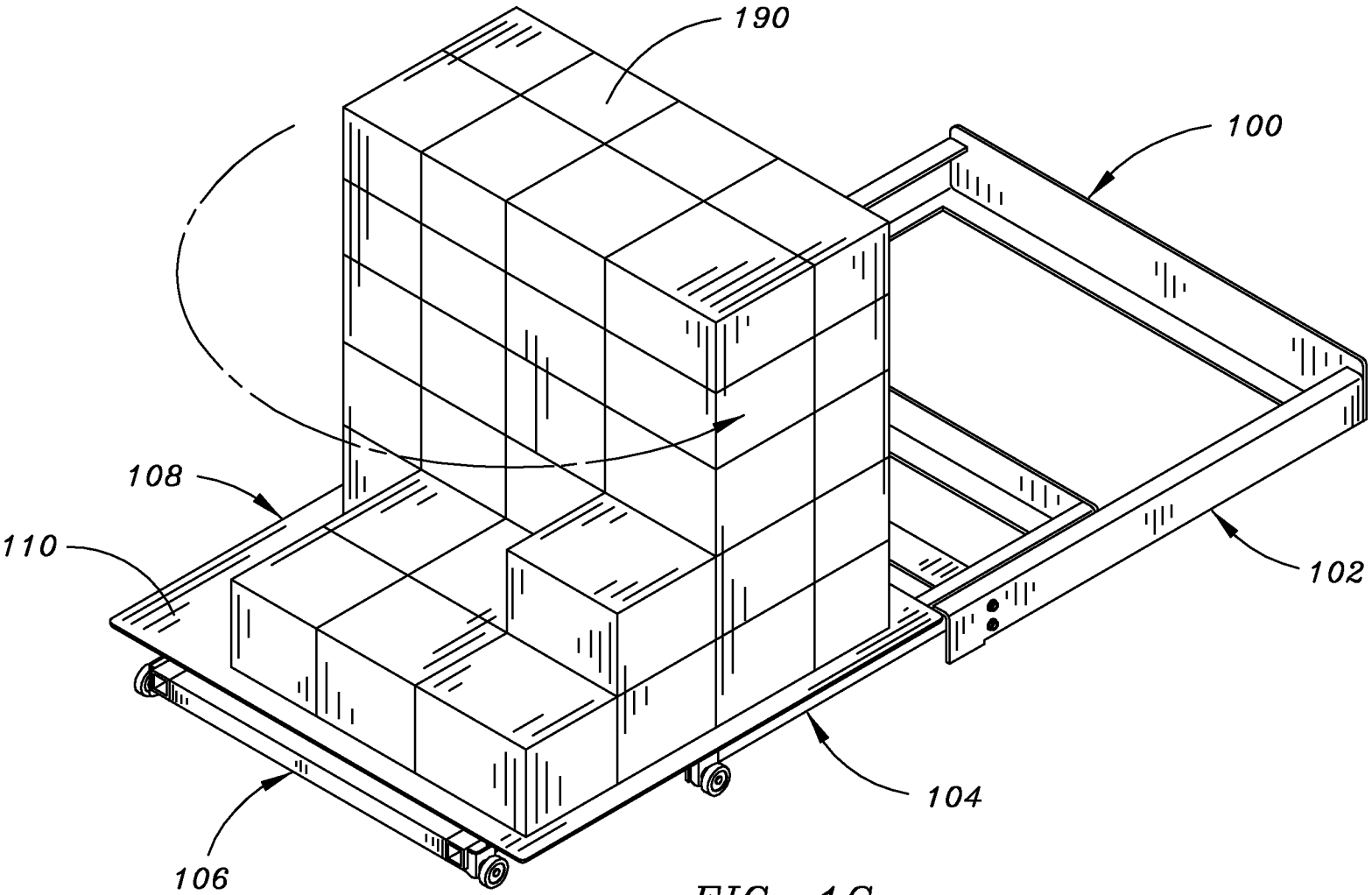
Figure 1D:
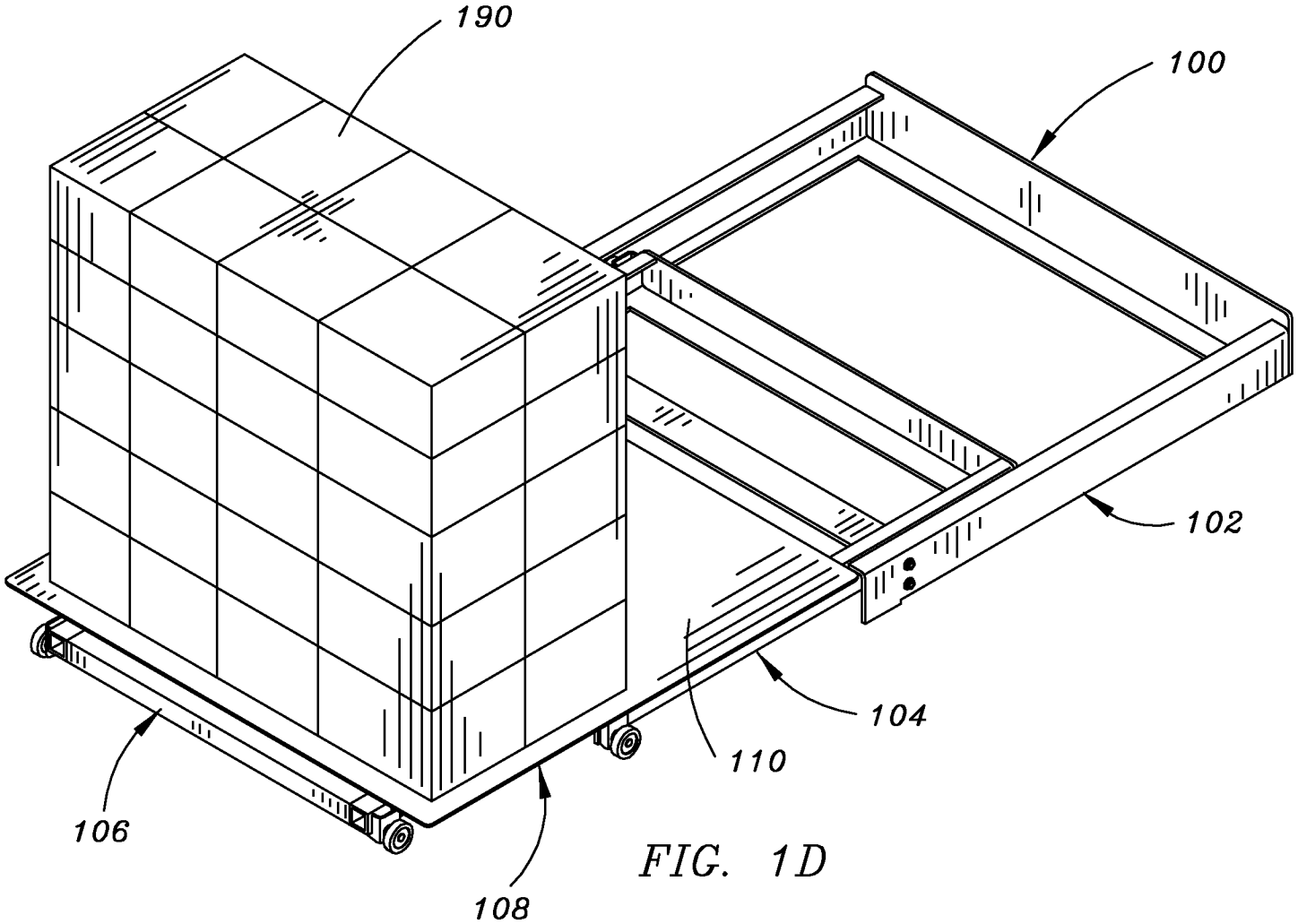
Figure 1E:
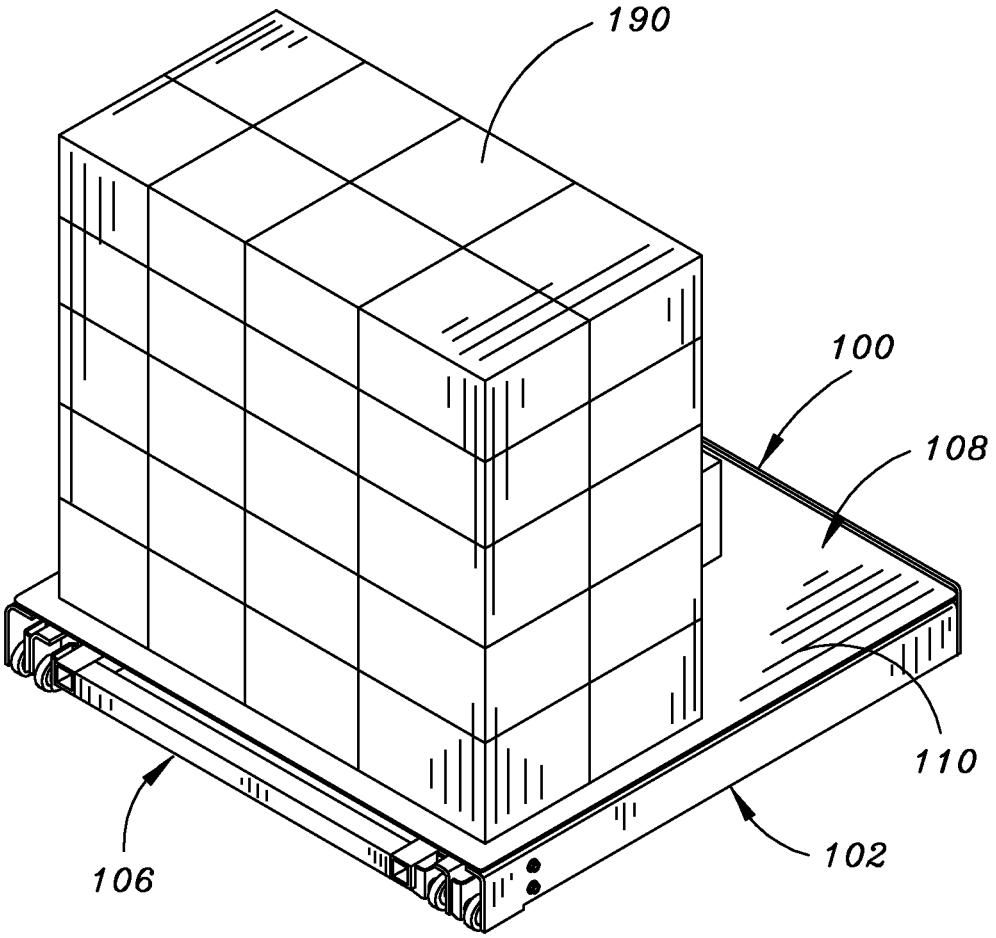

The extensible frame 106 is coupled with the base frame 102 and configured to translate between a retracted orientation with respect to the base frame 102 (e.g., as shown in FIGS. 1A, 1B, and 1E) and an extended orientation with respect to the base frame 102 (e.g., as shown in FIGS. 1C and 1D). In this manner, the pallet assemblies 100 can provide access to the stacked goods 190. For instance, by positioning the extensible frame 106 in an extended (e.g., hilly extended, partially extended) orientation, access may be provided to goods 190 that might not otherwise be accessed on the pallet assembly 100. For example, when multiple pallets are positioned directly next to one another and/or when a pallet assembly 100 is positioned under an overhang (e.g., a shelf), extending the extensible frame 106 to an extended position can facilitate access to the goods 190.

A support surface 110 is disposed of the extensible frame 106 for supporting the goods 190. In some embodiments, the support surface 110 can comprise a surface of the extensible frame 106. In other embodiments, the support surface. 110 can be provided by a support 108 supported by the extensible frame 106. In some embodiments, the support 108 can be configured to rotate with respect to the extensible frame 106 to provide access to the goods 190 (e.g., as shown in FIGS. 1C and 1D). Thus, as goods 190 stacked on or near one side of a pallet assembly 100 are depleted, access can be provided to goods stacked on or near another (e.g., opposite) side of the pallet assembly 100 by rotating the support 108 (e.g., rotating the support 108 by an angle of about one hundred and eighty degrees (180°)). Further, when a pallet-sized container is stored on a pallet assembly 100, access to various sides of the pallet-sized container can be provided by rotating the support 108. The support 108 can be rotated when the pallet assembly 100 is in a retracted position or an extended position.

In some embodiments, the extensible frame 106 can be directly coupled with the base frame 102. For example, the extensible frame 106 can slide within one or more tracks/channels of the base frame 102. In other embodiments, the extensible frame 106 is coupled with the base frame 102 via one or more additional extensible frames (e.g., an extensible frame 104). For example, the extensible frame 104 is slidably coupled with the base frame 102, and the extensible frame 106 is slidably coupled with the extensible frame 104. As shown in FIGS. 1 through 6, the extensible frame 104 facilitates translation of the extensible frame 106 between its retracted orientation with respect to the base frame 102 and its extended orientation with respect to the base frame 102. However, one (1) additional extensible frame is provided by way of example only and is not meant to be restrictive of the present disclosure. Thus, in other embodiments, more than one (1) additional extensible frame can be included with a pallet assembly 100 (e.g., two (2) additional extensible frames, three (3) additional extensible frames, etc.), Referring now to FIG. 2, the support 108 may be coupled to the extensible frame 106 via a spindle 112 (e.g., a steel pipe segment welded to a steel support 108) received in an aperture 114 defined in a steel extensible frame 106. In this manner, the support 108 and its associated support surface 110 can rotate with respect to the extensible frame 106. The support 108 can be supported on the extensible frame 106 via the spindle 112 and/or via one or more bearings, such as ball transfer units 116 protruding from the extensible frame 106. In embodiments, an array of ball transfer units 116 can be used to support the support 108, where each ball transfer unit 116 includes a ball 118 mounted partially within a restraining fixture (e.g., where the ball 118 is supported by smaller ball bearings within the fixture). In embodiments of the disclosure, one or more of the ball transfer units 116 can include a sensor (e.g., a pressure sensor) operable to sense a loading condition of a pallet assembly 100. For example, one or more sensors can be connected to a computing device and used to determine a characteristic (e.g., weight, quantity, etc.) of goods 190 supported on the support surface 110 of a pallet assembly 100. A characteristic determined in this manner can be compared to and/or associated with sales data, inventory data, reorder request data, product tracking data, and so forth, which can be communicated to one or more peripheral computing devices for presentation to a user.

The extensible frame 106 can include a pull ring 120 for facilitating extension of the extensible frame 106. For example a pull-rope and/or pull-hook can be connected to the pull ring 120 and pulled to extend the extensible frame 106. The extensible frame 106 can include multiple bearings (e.g., radial ball bearings 122) to facilitate translation of the extensible frame 106 between its retracted and extended orientations. The radial ball bearings 122 can be appropriately sized to travel within a track/channel defined in the base frame 102 and/or the extensible frame 104. Further, the radial ball bearings 122 can be constructed of a material configured to support the extensible frame 106 and the goods 190 on a support surface, such as the concrete floor of a warehouse. For example, one or more of the radial ball bearings 122 can have an outer race formed using stainless steel.

Referring now to FIG. 3, the extensible frame 104 can include bearings (e.g., radial ball bearings 124) to facilitate translation of the extensible frame 106 between its retracted and extended orientations. The radial ball bearings 124 can be appropriately sized to travel within a track/channel defined in the base frame 102. Further, the radial ball bearings 124 can be constructed of a material configured to support the extensible frame 104 on a support surface such as the concrete floor of a warehouse. For example, one or more of the radial ball bearings 124 can have an outer race formed using stainless steel. The extensible frame 104 can be formed of steel, and can include two channels 126 configured to receive the extensible frame 106 so that the extensible frame 106 is slidably coupled with the extensible frame 104. The extensible frame 104 can also include one or more stops 128, which can be used to stop the travel of the extensible frame 106 with respect to the extensible frame 104. One or more of the stops 128 can be formed using steel angles attached to a channel 126.

Referring now to FIG, 4, the base frame 102 can be formed of steel, and can include two channels 130 configured to receive the extensible frame 104 so that the extensible frame 104 is slidably coupled with the base frame 102. The base frame 102 can also include one or more stops 132, which can be used to stop the travel of the extensible frame 104 with respect to the base frame 102. One or more of the stops 132 can be formed using steel angles. It should be noted that while various materials have been described for the base frame 102, the extensible frames 104 and 106, the support 108, the spindle 112, the channels 126 and 130, the stops 128 and 132, and so forth, these materials are provided by way of example only and are not meant to be restrictive of the present disclosure. Thus, in other embodiments, various materials can be used for a support assembly 100 including, but not necessarily limited to: steel, stainless steel, iron (e.g., cast iron), and so forth.

Referring now to FIGS. 7A through 11C, pallet assemblies 100 are described that include a base frame 102, an extensible frame 106, and one or more support members 134 configured to support the base frame 102. As described, the pallet assemblies 100 are configured to receive stacked goods 190. The extensible frame 106 is coupled with the base frame 102 and configured to translate between a retracted orientation with respect to the base frame 102 (e.g., as shown in FIGS. 7A and 7B) and an extended orientation with respect to the base frame 102 (e.g., as shown in FIG, 7C). The pallet assemblies 100 provide access to the stacked goods 190. As described, a support surface 110 is disposed of the extensible frame 106 for supporting the goods 190. In some embodiments, the support surface 110 comprises a surface of the extensible frame 106. In other embodiments, the support surface 110 is provided by a support 108 supported by the extensible frame 106. In some embodiments, the support 108 can be configured to rotate with respect to the extensible frame 106 to provide access to the goods 190 (e.g., as shown in FIG. 7C).

As shown, the support members 13.4 support the base frame 102 and can be used to anchor the base frame 102 to, for example, a pallet rack 150. For example, one or more of the support members 134 defines a notch 136 configured to rest on a rail 152 of a pallet rack 150. In this manner, a pallet assembly 100 can be anchored to the pallet rack 150 so that the base frame 102 of the pallet assembly 100 does not slide relative to the pallet rack 150 as the extensible frame 106 translates between its retracted orientation with respect to the base frame 102 and its extended orientation with respect to the base frame 102. However, this configuration is provided by way of example only and is not meant to limit the present disclosure. Thus, in other embodiments, a rail 152 of a pallet rack 150 can define a notch upon which the pallet assembly 100 rests. Further, one or more of the support members 134 can be fixedly connected to a rail 152 of a pallet rack 150 using, for example, fasteners (e.g., screws, bolts, pins, and so forth). One or more of the support members 134 can also be welded to a rail 152 of a pallet rack 150.

In embodiments of the disclosure, the support members 134 are fixedly connected to the base frame 102 using, for example, fasteners (e.g., screws, bolts, pins, and so forth). One or more of the support members 13.4 can also be welded to the base frame 102. However, this configuration is provided by way of example only and is not meant to limit the present disclosure. Thus, in other embodiments, a base frame 102 can be anchored to a support member 134 by defining a notch that rests on a corresponding portion of a support member 134 in the manner of notch 136 configured to rest on rail 152 of pallet rack 150). in other embodiments, one or more of the support members 134 defines a notch upon which the base frame 102 rests, and so forth. Further, it should be noted that in some embodiments, a notch 136 configured to rest on a rail 152 of a pallet rack 150 is defined by the base frame 102. For instance, one or more of the channels 130 of the base frame 102 (e.g., as described with reference to FIG. 4) can define a notch 136 configured to rest on a rail 152 of a pallet rack 150. In this example, a pallet assembly 100 does not necessarily include a support member 134. In other instances, a support member 134 is integrally formed with a channel 130.

In embodiments of the disclosure, one or more of the support members 134 and the base frame 102 defines an interface member (e.g., a hook 138) for interfacing with a. corresponding portion of for example, a platform 160. For instance, the platform 160 includes a support surface 162 that defines a number of apertures 164 for receiving hooks 138 of support. members 134. The platform 160 also includes one or more receiving portions (e.g., channels 166) for receiving an attachment of a lifting device, such as a forklift truck 170. For instance, one or more attachments (e.g., tines or forks 172) of a forklift truck 170 are inserted into channels 166 for lifting the platform 160. The platform 160 can also include a rail 168.

As shown in FIGS. 11A through 11C, the platform 160 can be lifted and then placed into engagement with the hooks 138 of the support members 134. As shown, the support surface 110 of the support 108 and the support surface 162 of the platform 160 are in at least substantially the same horizontal plane 180 when the platform 160 is positioned to receive the hooks 138 in apertures 164 (e.g., as shown in FIG. 11C). In this manner, the radial ball bearings 122 (FIG. 2) and/or the radial ball bearings 124 (FIG. 3) that facilitate translation of the extensible frame 106 between its retracted and extended orientations roll along the support surface 110 of the support 108 and the support surface 162 of the platform 160 to position the extensible frame 106.

Conclusion

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A pallet assembly comprising:

a base frame;

an extensible frame coupled with the base frame and configured to translate between a retracted orientation with respect to the base frame and an extended orientation with respect to the base frame; and a support having a support surface configured to support product thereon, the support disposed on the extensible frame and the support surface being positioned above the base frame and the extensible frame.

2. The pallet assembly as recited in claim 1, further comprising a second extensible frame coupled between the base frame and the extensible frame to facilitate translation of the extensible frame between the retracted orientation with respect to the base frame and the extended orientation with respect to the base frame.

3. The pallet assembly as recited in claim 1, wherein the support is coupled to at least one of the base frame and the extensible frame via a support to facilitate vertical support.

4. The pallet assembly as recited in claim 3, wherein the support is configured to rotate with respect to the extensible frame.

5. The pallet assembly as recited in claim 3, wherein extensible frame comprises a plurality of bearings for supporting the support.

6. The pallet assembly as recited in claim 1, wherein the extensible frame comprises a pull ring to facilitate extension of the extensible frame.

7. The pallet assembly as recited in claim 1, wherein the extensible frame comprises a plurality of radial ball bearings configured to support the extensible frame with respect to the base frame.

8. The pallet assembly as recited in claim 1, further comprising a stop for stopping travel of the extensible frame with respect to the base frame.

9. The pallet assembly as recited in claim 1, further comprising a support member for supporting the base frame, the support member comprising an interface member configured to interface with a platform having a second support surface, wherein, when the platform is engaged with the interface member of the support member, the first support surface and the second support surface are in at least substantially the same horizontal plane.

10. A pallet assembly comprising:

a base frame;

a first extensible frame coupled with the base frame and configured to translate between a retracted orientation with respect to the base frame and an extended orientation with respect to the base frame, the first extensible frame including a plurality of ball transfer units;

a second extensible frame coupled between the base frame and the first extensible frame to facilitate translation of the first extensible frame between the retracted orientation with respect to the base frame and the extended orientation with respect to the base frame; and a support having a support surface configured to support product thereon, the support surface being positioned above the base frame, the first extensible frame and the second extensible frame, wherein the support is configured to rotate with respect to the first extensible frame.

11. The pallet assembly as recited in claim 10, wherein the first extensible frame comprises a pull ring to facilitate extension of the first extensible frame.

12. The pallet assembly as recited in claim 10, wherein the first extensible frame comprises a plurality of radial ball bearings configured to support the first extensible frame with respect to the second extensible frame.

13. The pallet assembly as recited in claim 10, wherein the second extensible frame comprises a plurality of radial ball bearings configured to support the second extensible frame with respect to the base frame.

14. The pallet assembly as recited in claim 10, further comprising a stop for stopping travel of at least one of the first extensible frame or the second extensible frame.

15. The pallet assembly as recited in claim 10, further comprising a support member for supporting the base frame, the support member comprising an interface member configured to interface with a platform having a second support surface, wherein, when the platform is engaged with the interface member of the support member, the first support surface and the second support surface are in at least substantially the same horizontal plane.

16. A pallet assembly comprising:

a base frame;

an extensible frame coupled with the base frame and configured to translate between a retracted orientation with respect to the base frame and an extended orientation with respect to the base frame; and a support having a support surface configured to support product thereon, the support surface being positioned above the base frame and the extensible frame, the support being coupled to the extensible frame via a rotational coupling, wherein the rotational coupling facilitates horizontal rotation of the support surface with respect to the extensible frame.

17. The pallet assembly as recited in claim 16, further comprising a second extensible frame coupled between the base frame and the extensible frame to facilitate translation of the extensible frame between the retracted orientation with respect to the base frame and the extended orientation with respect to the base frame.

18. The pallet assembly as recited in claim 16, wherein the extensible frame comprises a plurality of bearings for supporting the support.

19. The pallet assembly as recited in claim 16, wherein the extensible frame comprises a pull ring to facilitate extension of the extensible frame.

20. The pallet assembly as recited in claim 16, wherein the extensible frame comprises a plurality of radial ball bearings configured to support the extensible frame with respect to the base frame.

21. The pallet assembly as recited in claim 16, further comprising a stop for stopping travel of the extensible frame with respect to the base frame.

22. The pallet assembly as recited in claim 16, further comprising a support member for supporting the base frame, the support member comprising an interface member configured to interface with a platform having a second support surface, wherein, when the platform is engaged with the interface member of the support member, the first support surface and the second support surface are in at least substantially the same horizontal plane.

* * * * *